United States Patent [19]

Bielagus

[11] Patent Number: 4,741,444

[45] Date of Patent: May 3, 1988

[54] DISC MODULE SPACER IMPROVEMENT

[75] Inventor: Joseph B. Bielagus, Tualatin, Oreg.

[73] Assignee: Beloit Corporation, Beloit, Wis.

[21] Appl. No.: 1,473

[22] Filed: Jan. 8, 1987

[51] Int. Cl.[4] ..... B07B 1/16

[52] U.S. Cl. ..... 209/672; 209/931

[58] Field of Search ..... 209/672, 667, 660, 659, 209/668, 671, 674, 676, 679, 931, 274, 279

[56] References Cited

U.S. PATENT DOCUMENTS

| | | | |
|---|---|---|---|
| 1,524,360 | 1/1925 | Lauritzen | 209/671 |
| 1,679,593 | 8/1978 | Williamson et al. | 209/672 |
| 1,899,737 | 2/1933 | Ulrich | 209/672 |
| 2,949,189 | 8/1960 | Haines | 209/931 |
| 3,306,441 | 2/1967 | Sanders et al. | 209/672 |
| 3,771,651 | 11/1973 | Hook | 209/672 |
| 4,037,723 | 6/1977 | Wahl et al. | 209/671 X |
| 4,301,930 | 11/1981 | Smith | 209/672 X |
| 4,452,694 | 6/1984 | Christensen et al. | 209/672 |
| 4,538,734 | 9/1985 | Gill | 209/668 |
| 4,653,648 | 3/1987 | Bielagus | 209/672 |

FOREIGN PATENT DOCUMENTS

| | | | |
|---|---|---|---|
| 610574 | 1/1977 | U.S.S.R. | 209/676 |

*Primary Examiner*—Robert B. Reeves
*Assistant Examiner*—Edward M. Wacyra
*Attorney, Agent, or Firm*—Dirk J. Veneman; Raymond W. Campbell

[57] ABSTRACT

A disc screen or like shaft structure in which screen discs 25 and spacers 28 are connected together in modular relation. The spacers 28 support the discs axially and are formed of plastic to allow the discs to deflect from their radial plane and the plastic spacers have an outer metallic surround 30 which is of smaller length than the spacers to present a protective metallic outwardly facing surface but allow the discs 25 to deflect laterally. The assembly is placed under a predetermined end-wise compression and the module is mounted on a rectangular shaft 27 which is suitably supported for rotation.

13 Claims, 3 Drawing Sheets

DISC MODULE SPACER IMPROVEMENT

DESCRIPTION

Disc screens are desirable apparatus for screening or classifying discrete materials such as paper pulp, municipal wastes, and the like. Such screens comprise a screening bed having a series of corotating spaced parallel shafts each of which has a longitudinal series of concentric screen discs which interdigitate with the screen discs of the adjacent shafts. Spaces between the discs permit only material of acceptable size to pass downwardly through the rotating discs bed, and since the discs are all driven to rotate in a common direction from the infeed in end of the screen bed to the outfeed or discharge end of the bed, the particles of material which are larger than the acceptable sizes of material will be advanced on the bed to the outfeed end of the bed and rejected.

Several prior expedients have been heretofore devised for mounting the disks on the shafts, but there has been a persistent need for improvements as will be apparent from the following discussion of certain prior arrangements.

For example, in U.S. Pat. No. 4,239,119 the discs are provided with central holes having spline projections that engage in perforated retaining plates arranged to be received about a shaft. The splines which extend through the perforations of the plates fit closely at their ends against the shaft and are wedged in the plates. In practice, though not so stated in the patent, it has been found necessary to weld the discs to the plates for stability.

In U.S. Pat. No. 4,037,723, the discs are in direct engagement at their inner edges with the square tubing shaft, and tubular spacers engage endwise with the discs.

In another arrangement, as disclosed in U.S. Pat. No. 4,301,930, the discs are welded to cylindrical module hubs and the modules are assembled end-to-end on shafts.

In my copending U.S. Pat. Ser. No. 724,098 filed Apr. 17, 1985, now U.S. Pat. No. 4,653,648, an arrangement is disclosed and claimed providing advancements which eliminate certain difficulties of the prior art. It has been discovered that with the radially outwardly facing plastic surfaces provided by plastic spacers of some materials, that significant deterioration can occur under some conditions. This has been discovered with accelerated wear tests in the laboratory so that indications of failure have been found which would indicate that significant deterioration of the plastic spacer would occur in one year's use. The polyurethane spacer can experience gouging and pitting during normal use. Yet, the substitution of a metal spacer eliminates performance characteristics which are necessary in that in normal usage, foreign objects such as large chips, rocks or other objects, enter the screen and lodge between the discs, being trapped there if the discs are held rigid. In preventing disc breakage due to such phenomena, the discs are allowed to flex so that oversized chips and other such objects will be allowed to pass through the screen. The installation of a spacer which does not afford the yieldability of a plastic spacer will not permit this. It has also been found that when the screens are utilized in the paper industry in plants which process material for paper coaters, the coating industry does not like equipment which presents plastic surfaces so that use of equipment with the plastic spacers such as known from the aforementioned application are not acceptable by papermakers which have coating equipment in their plants.

Among the common difficulties experienced with other prior art arrangements not using plastic spacers are that modules are very difficult to remove after a short period of operation because of fretting and corrosion between the modules and the shaft. Fabrication and assembly are expensive and time consuming. Quality control is difficult due to the number of operations and parts involved. Where prior devices employ welding and mechanical binding of the discs, there may be slight variations from true radial mountings so that there is a certain amount of wobble or variations in the interface spacings which force the discs out of their desirable radial planes. It has been found that frequently the discs will loosen after several months of service. A number of these difficulties have been avoided by the concept of my copending application, Ser. No. 724,098, but certain problems and deficiencies still occur due to the objectionable presence of plastic surfaces, the wear and deterioration of the outer surface of the plastic ahd other disadvantages which limit the useful life.

It is accordingly an important object of the present invention to avoid the disadvantage present in prior art devices heretofore known and provide a screen disc module structure which has a long operating life and is capable of handling materials in the papermaking industry on a continuous operational basis without requiring frequent attention and replacement.

A still further object of the invention is to provide a screen disc arrangement wherein the discs are somewhat elastically supported so as to be able to deflect out of their radial plane on a temporary basis to accommodate lumpy foreign elements and automatically return to their radial planes after the foreign elements have been discharged.

A further object of the invention is to provide a structure which retains all of the advantages provided by a plastic spacer structure for screen discs and yet eliminates any disadvantages introduced by such a structure.

A general object of the invention is to provide a new and improved disc screen shaft assembly where there is excellent control of disc wobble, an improved connection and support of the discs at their hubs, a structure attaining positive shaft driving of the discs and preventing loosening of the discs, and accomplishing the foregoing actually extending the wear life of the structure.

In accordance with the principles of the invention, a module is formed of a plurality of screen discs in the radial plane with plastic spacers therebetween arranged and mounted so as to be driven by an internal shaft extending therethrough. The plastic spacers have a metal surround or ring which is perferably a small predetermined length shorter than the plastic spacer so that the plastic is protected and material between the discs encounters metal while the functioning of the plastic spacer is not impeded in that it permits deflection of the metal disc out of its normal radial plane due to material entering between the discs.

Other objects, features and advantages of the invention will be readily apparent from the teaching of the principles of the invention in connection with the disclosure of the preferred embodiment thereof in the specification, claims and drawings, in which:

Figure 1:
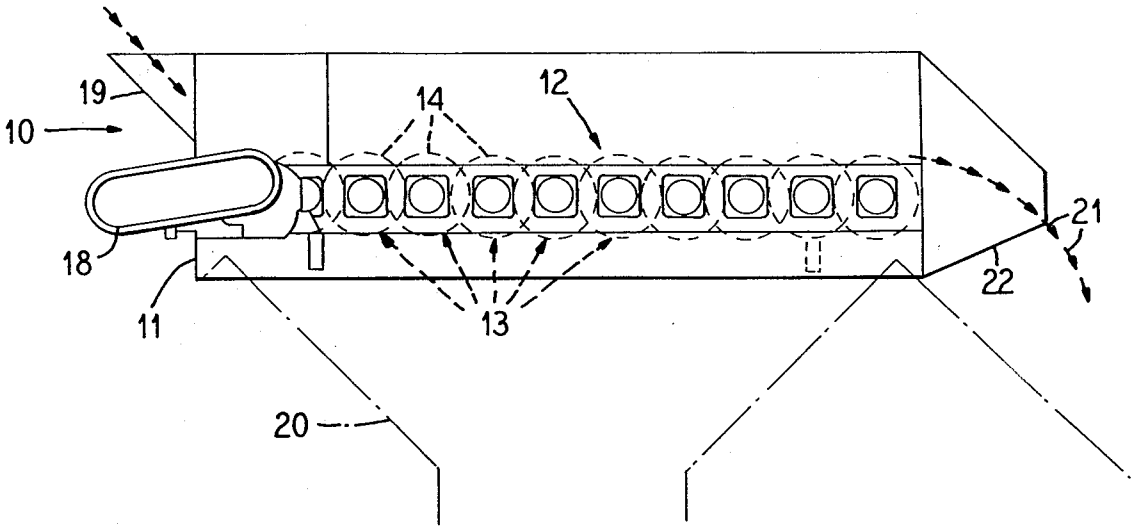
FIG. 1 is a somewhat schematic side elevational view of a disc screen apparatus embodying the features of the invention.

As illustrated in FIG. 1, a disc screen apparatus 10 comprises a frame 11 supporting a screening bed 12, having a series of corotating spaced parallel shaft assemblies 13 of cylindrical perimeter and similar length, and each of which has a longitudinal series of concentric metal screen discs 14. The discs 14 of each of the shaft assemblies 13 interdigitate with the discs of the adjacent shafts. Each of the shafts 13 is preferably hollow, with a stub shaft at both ends suitably journalled on the frame 11. Unison driving of the shafts 13 in the same direction, clockwise as seen in FIG. 1, is adapted to be effected by suitable drive means 18.

Figure 2:
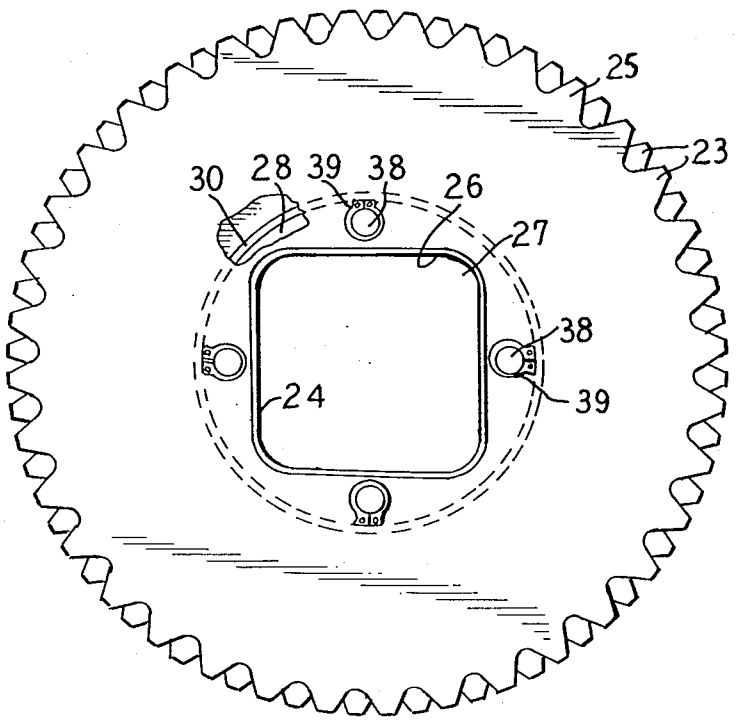
FIG. 2 is an end elevational view of one of the disc screen modules of the arrangement of FIG. 1.

Discrete material to be screen, is delivered to the infeed end of the screening bed 12 by means of a chute 19. Acceptable size particles drop through screening slots defined by and between the interdigitated portions of the discs 14, and are received in a hopper 20. Particles which are too large to pass through the screening slots are advanced to and discharged, and indicated by directional arrows 21, from the rejects end of the screening bed, as by means of an outfeed chute means 22. The screening function of the discs 14, may be enhanced by a uniform generally sawtooth configuration of the outer perimeters of the discs 10 provided by teeth 23 (FIG. 2). The number of such teeth and their size may be dictated by the particular material to be processed. Although shown as relatively sharp, sawtooth shape, the teeth 23 may, depending upon use, be of different geometric forms, such as lobulate or the like.

Each of the discs 14 is spaced from each adjacent disc throughout the entire set of discs in each of the shaft assemblies 13, to provide the desired screening slot spaces between the annular interdigitated areas of the discs.

Figure 3:
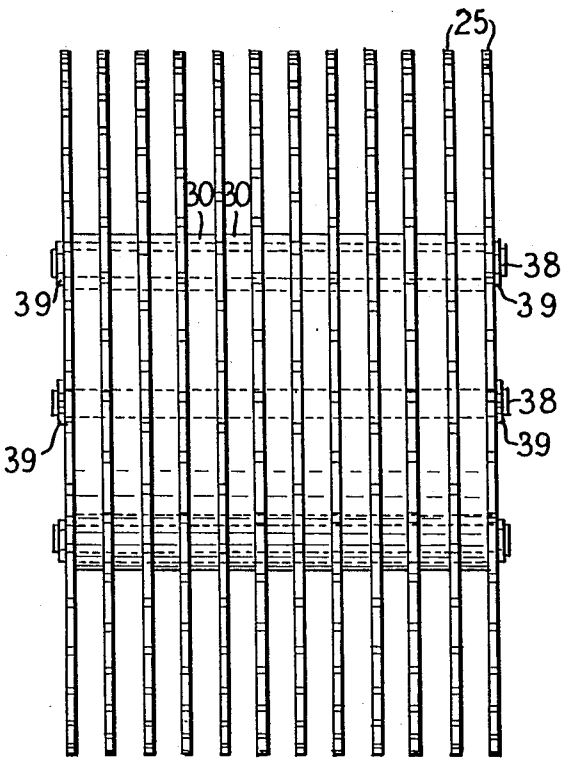
FIG. 3 is a side elevational view of the module of FIG. 2.
Figure 4:
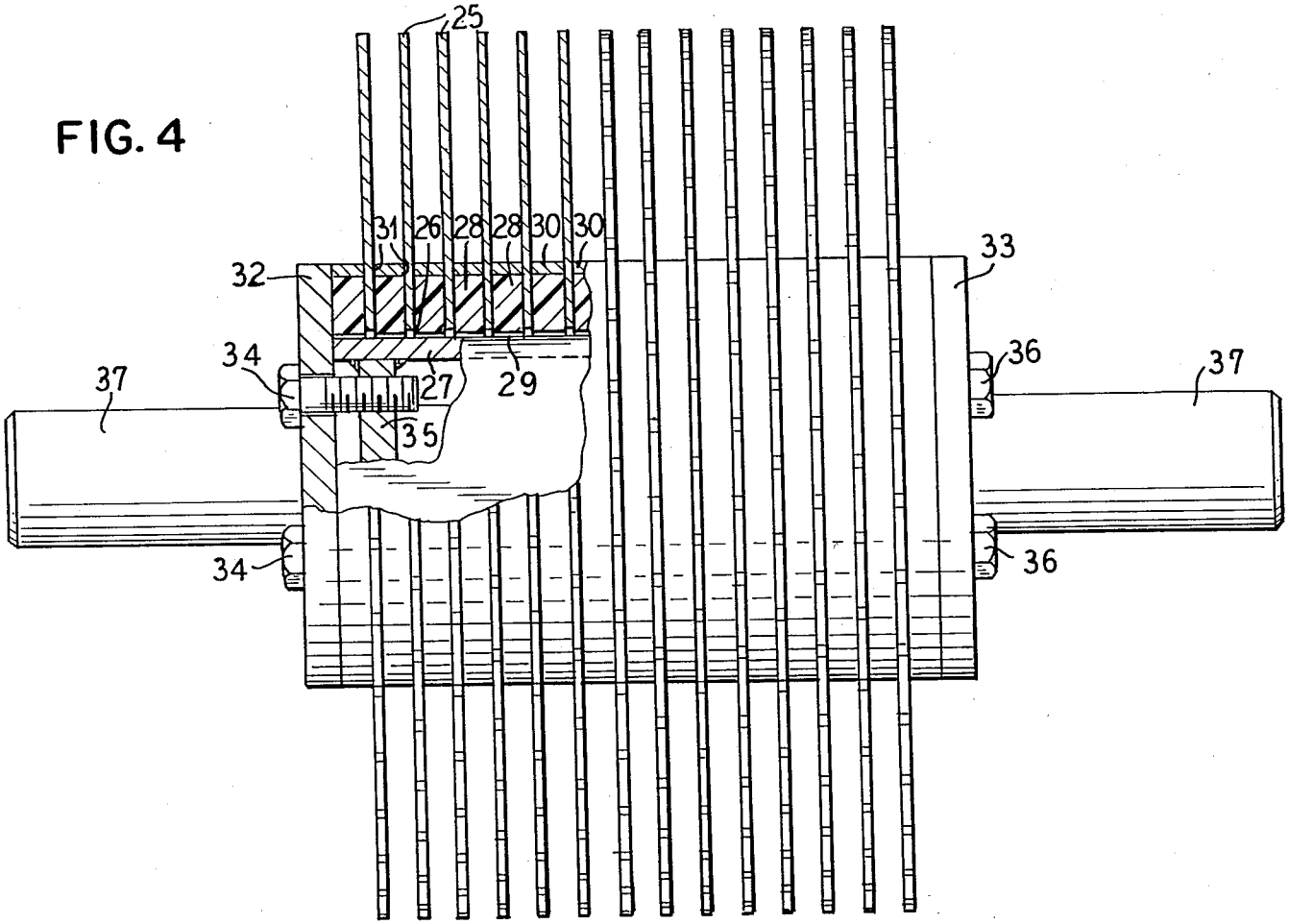
FIG. 4 is a side elevational view similar to FIG. 3 but with parts broken away to illustrate the internal construction of the module.

As illustrated in FIGS. 2 through 4, a plurality of screen discs 25 are provided which are mounted on a module assembly in axial spaced relation to provide spaces therebetween. The screen discs each extend in a relatively true radial plane being held in their spaced relationship but permitted to tilt or cock slightly when a foreign element is wedged between the discs.

For separating the discs 25 in their module, non-metallic spacers 28 are mounted between each of the discs. These spacers are preferably of polyurethane material such as a polyurethane 90 A durometer.

These plastic spacers 28 have radial faces so that they hold the discs in their radial planes except the plastic is sufficiently resilient when subjected to the large forces which would be caused by a particle wedging between the discs so that they deflect to allow the particle to be discharged and the disc thereby returns to its original position which is an accurate radial plane. For this purpose, the series of discs with their spacers are compressed by a predetermined axial force by clamping means. FIGS. 2 and 3 show one form of clamping means while FIG. 4 illustrates another form. With each of the forms functioning to provide a predetermined axial clamping force to hold the module together.

An important feature of the invention is to provide a surround or annular ring or collar 30 around the outer surface of the plastic spacer 28. These surrounds essentially close the space on the outer surface of the plastic spacers but in one form are slightly shorter than the spacers so that a space appears at 31 between the ends of the collars or surrounds 30 and the surfaces of the adjoining discs. In other words, the outer surfaces of the plastic spacers 28 are fully protected from material between the discs so that abrasive materials, stones and the like do not chip or scratch the outer surface of the plastic. Furthermore, there is no plastic exposed part which would be objectionable to papermakers which are working with coated papers. By making the surrounds slightly shorter in axial length than the spacers 28, the spacers can still function as elastic separators to permit deflection of the discs. That requires that the metal surrounds 30 be a sufficient distance shorter than the plastic spacers so that even when the plastic spacers are compressed in their module form, a slight space still resides at the ends of the metal surrounds so that they allow the discs to tilt slightly against the plastic spacers. By properly sizing the metal spacer ring, it will allow the disc to flex to a certain degree but will restrict flexing beyond that point. The allowed flexing permits the discharge of chips, rocks and other objects but limits the flexing so that the discs do not break due to interference with one another. In a preferred form, the metal surrounds or rings are sized so that after the compression of the plastic rings, thre is still clearance of approximately 0.381 mm between the ends of the steel ring and the discs. The compression of the plastic spacer when the module is assembled also forces a tight engagement between the annular metal ring and the outer surface of the plastic.

While a preferred form of the metal ring requires that it be slightly shorter than the plastic ring such that when the plastic ring is placed under axial compression there is still clearance at the end of the steel ring, in some forms it may be desirable to make the steel ring of a length so that the disc touches the end of the ring when the plastic ring is compressed. This still will allow deflection of the discs which will then act against both the metal ring and the plastic ring and since the metal ring is not thick, the resistance which it offers to axial compression is not great.

The inner edges of the disc 25 are so sized so that they do not seat firmly on the shaft 27 but allow a small space 26 between the shaft 27 and the discs. The spacers 28 are sized so that they can be slid over the rectangular shaft and a fairly small sliding space 29 occurs between the discs and the shaft but essentially the discs center the assembly on the shaft so that stable positioning of the parts occurs during rotation and vibration or oscillation is prevented.

With reference to FIGS. 2 and 3, in the arrangement shown for compression of the module, an axial force is applied on opposite ends of the module against the end discs and pins 38 extend through holes in the spacers and discs. Locking rings 29 rest in grooves at the ends of the pins and these locking rings will compressively hold the module into a tight unit. The rectangular shaft 27 is suitably mounted on a rotational shaft so that the entire unit will rotate in proper relationship to adjacent modular units as illustrated in connection with FIG. 1.

In the arrangement of FIG. 4, the rectangular shaft 27 has plates such as 35 welded therein spaced inwardly from the ends. An end plate 32 is clamped to the ends on one end and an end plate 33 is clamped to the ends on the other end with the end plate supplying a compressive force to the module. Cap screws 34 and 36 thread into the plates 35 and when tightened are drawn up tight against the ends of the shaft 27 which compresses the plastic spacers 28. A center rotary shaft 37 extends through the plates 35 for purposes of mounting the modular assembly for rotation. By choosing the length of the shaft 27 to be critical, the end plates 32 and 33 can be drawn down tightly against the ends of the shaft 27 by the bolts 34 and 36 so that the desired compression is applied to the module. As above discussed, the metal rings 30 are of a length so that a small space will remain at the ends of the rings to permit but to limit tilting movement or deflection of the screen discs 25.

Thus, it will be seen that I have provided a screen disc structure which meets the objectives and advantages above set forth and provides a long wearing structure simplified in assembly and construction which is capable of processing material in an improved manner.

I claim:

1. A disc screen or like rotatable shaft assembly comprising:

an elongate metallic shaft member;

a plurality of screen discs mounted co-rotatively on said shaft member and having central shaft receiving openings complementary to said shaft member with the discs mounted in spaced relation axially along the shaft member;

non-metallic spacers between said discs accommodating limited tilting of the discs relative to the axis of the shaft with deflection of the spacers;

metallic surrounds for each of the spacers having an axial dimension slightly less then the spacers so that the spacers accommodate tilting of the discs without constraint from said surrounds; and means for axially compressively connecting said discs and spacers together and for expanding said spacers radially against said surrounds, securing said discs, spacers, and surrounds into a modular unit which can be supported on the shaft member.

2. A disc screen or like rotatable shaft assembly constructed in accordance with claim 1:

wherein said module is under a predetermined endwise compression by said connecting means with the compression accommodating spacing between the ends of said surrounds and said discs.

3. A disc screen or like rotatable shaft assembly constructed in accordance with claim 2:

wherein said predetermined axial compression is provided by axially extending metal pins with members engaging the end discs in a module.

4. A disc screen or like rotatable shaft assembly constructed in accordance with claim 3:

wherein said pins are in the form of a plurality of bolts extending through said spacers and said discs with the ends of said bolts projecting beyond the endmost disc of the module with snap ring means carried on the bolt ends and maintaining the module unit under axial pressure.

5. A disc screen or like rotatable shaft assembly comprising:

an elongate shaft member;

a plurality of metallic screen discs mounted co-rotatively on said shaft member and having central shaft receiving openings through which the shaft extends co-axially;

non-metallic resilient spacers between each of said discs accommodating deflection of the discs with compression of the spacers;

an annular protective surround for each of the spacers providing a radially outwardly facing metallic protective surface for each of the spacers to face material between said discs; and means for axially compressively connecting said discs and spacers together and for expanding said spacers radially against said surrounds, securing said discs, spacers, and surrounds into a modular unit which can be mounted on the shaft member.

6. A disc screen or like rotatable shaft assembly constructed in accordance with claim 5:

wherein said surrounds are of an axial length slightly less than the axial length of said spacers so that deflection of the discs out of their radial planes will compress the spacers but not said surrounds.

7. A disc screen or like rotatable shaft assembly constructed in accordance with claim 5:

wherein said spacers have an annular outer surface and said surrounds are in the form of annular rings with an inner surface substantially of the diameter of the outer surface of the spacers to fit snugly thereon.

8. A disc screen or like rotatable shaft assembly constructed in accordance with claim 5:

wherein said spacers are of a compressible hard plastic.

9. A disc screen or like rotatable shaft assembly constructed in accordance with claim 8:

including an axially extending bolt member applying a compressive force to the assembly of discs and spacers to slightly compress the spacers an amount permitting additional compression with deflection of the screen discs out of their radial planes.

10. A disc screen or like rotatable shaft assembly constructed in accordance with claim 5:

wherein the axial length of the metal surround is such that an axial clearance on the order of 0.381 mm remains between the ends of the surrounds and the sides of the discs.

11. The module assembly of disc screens for a screen disc operation in a paper pulp treating structure comprising in combination:

a plurality of metallic screen discs having a general circular shape mounted in parallel radial planes with central generally rectangular openings;

an elongate metallic shaft member extending through the screen discs having a generally rectangular outer surface of a size slightly less than the inner openings of the screen discs;

a plastic spacer axially located between each of the discs with the radial inner surfaces of the spacers engaging said shaft member;

an annular metal surround for each of the plastic spacers presenting a protective radially outwardly facing metallic surface engaging material between the discs and relatively tightly fitted to the outer surface of the plastic spacer, the axial length of the surround being less than the spacer so that the spacer can deflect with deflection of the screen discs out of their normal radial plane;

an axially extending module compression bolt extending axially through the discs and spacers holding the assembly in compression.

12. The module assembly of disc screens for a screen disc operation in a paper pulp treating structure constructed in accordance with claim 11:

wherein said bolt includes bolts quadrilaterally arranged relative to the shaft member with locking rings on the ends to hold the assembly in compression.

13. The module assembly of disc screens for a screen disc operation in a paper pulp treating structure constructed in accordance with claim 11:

wherein the assembly includes a supporting rotating shaft supportably engaging said shaft member.

* * * * *